US009704497B2

(12) United States Patent
Porter et al.

(10) Patent No.: US 9,704,497 B2
(45) Date of Patent: Jul. 11, 2017

(54) METHOD AND SYSTEM OF AUDIO POWER REDUCTION AND THERMAL MITIGATION USING PSYCHOACOUSTIC TECHNIQUES

(71) Applicant: Apple Inc., Cupertino, CA (US)

(72) Inventors: Simon K. Porter, San Jose, CA (US); Eric A. Allamanche, Sunnyvale, CA (US); Richard M. Powell, Mountain View, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 14/792,373

(22) Filed: Jul. 6, 2015

(65) Prior Publication Data

US 2017/0011748 A1 Jan. 12, 2017

(51) Int. Cl.

| | |
|---|---|
| ***G10L 19/032*** | (2013.01) |
| ***H04R 29/00*** | (2006.01) |
| ***H04R 3/00*** | (2006.01) |

(52) U.S. Cl.

CPC ..... *G10L 19/032* (2013.01); *H04R 3/007* (2013.01); *H04R 29/001* (2013.01); *H04R 2430/03* (2013.01)

(58) Field of Classification Search

CPC ..... G10L 19/032; H04R 29/001

See application file for complete search history.

(56) References Cited

U.S. PATENT DOCUMENTS

| | | | | |
|---|---|---|---|---|
| 5,185,800 | A | 2/1993 | Mahieux | |
| 5,684,922 | A | 11/1997 | Miyakawa et al. | |
| 7,225,123 | B2 | 5/2007 | Ha | |
| 7,313,520 | B2 | 12/2007 | Plummer | |
| 7,440,750 | B2 | 10/2008 | Howard | |
| 7,899,192 | B2 | 3/2011 | Oxford et al. | |
| 8,391,212 | B2 | 3/2013 | Gao | |
| 8,559,655 | B2 | 10/2013 | Mihelich et al. | |
| 2010/0174542 | A1* | 7/2010 | Vos | G10L 19/04 704/230 |
| 2010/0290643 | A1* | 11/2010 | Mihelich | H04S 7/301 381/99 |
| 2011/0075855 | A1* | 3/2011 | Oh | G10L 19/032 381/73.1 |

(Continued)

FOREIGN PATENT DOCUMENTS

| | | |
|---|---|---|
| WO | WO-0233832 | 4/2002 |

OTHER PUBLICATIONS

Datta, Srabosti, "Power Reduction by Dynamically Varying Sampling Rate" (2006), University of Kentucky Master's Theses. Paper 275. http:/uknowledge.uky.edu/gradschool_theses/275.

*Primary Examiner* — Qian Yang

(74) *Attorney, Agent, or Firm* — Blakely, Sokoloff, Taylor & Zafman LLP

(57) ABSTRACT

Method of audio power reduction and thermal mitigation using psychoacoustic techniques starts by receiving a decoded audio signal in a reproduction system. Decoded audio signal is a signal that is decompressed and to be played back by a speaker. A masking curve is generated based on psychoacoustic models and the decoded audio signal. The masking curve is applied to the decoded audio signal to remove unheard frequencies and to generate a power-reduced audio signal. Other embodiments are also described.

25 Claims, 6 Drawing Sheets

(56) References Cited

U.S. PATENT DOCUMENTS

| | | | | |
|---|---|---|---|---|
| 2012/0195442 | A1* | 8/2012 | Villemoes | G10L 19/265 381/98 |
| 2013/0343585 | A1* | 12/2013 | Bennett | H04R 25/554 381/315 |

* cited by examiner

METHOD AND SYSTEM OF AUDIO POWER REDUCTION AND THERMAL MITIGATION USING PSYCHOACOUSTIC TECHNIQUES

FIELD

An embodiment of the invention relate generally to a system and a method of audio power reduction and thermal mitigation using psychoacoustic techniques. Specifically, the system and method applies psychoacoustic techniques to remove unheard frequencies from decoded acoustic signals in order to reduce the frequencies being generated by a speaker, and thereby reducing the power required by the speaker as well as mitigating the heat produced by the speaker, amplifier and power supply.

BACKGROUND

Psychoacoustics is a study of sound perception which shows that the human ear and the brain are involved in the signal processing of sound such that in various conditions, certain frequencies of the sound may be unheard.

Moving Picture Experts Group (MPEG) and other audio encoding technologies use these psychoacoustics principles to perform encoding and decoding of audio signals. For instance, high quality lossy audio signal compression may be achieved by identifying the parts of the audio signal that are unheard by the listener such that these parts may be allocated a lower priority in compression (e.g., may be lost in compression). Perpetual encoders utilized this fact to quantize or remove different frequencies so that they can compress an audio signal without introducing distortion. Additionally, the listener may not perceive the introduction of distortion in the audio signal during encoding. For example, it is well known that tones mask noise in an audio signal.

SUMMARY

Parseval's theorem is that the power in the frequency domain is equal to power in the time domain. In the present invention, Parseval's theorem is used to reduce the power in the time domain required to reproduce an audio signal using a speaker. In lieu of using the psychoacoustic principles during the encoding/decoding phase, our invention pertains to using the psychoacoustic principles to build masking curves based on frequencies that are not heard by the user and remove those unheard frequencies from the signal prior to the speaker reproducing the signal. By decreasing the number of frequencies from the signal to be reproduced, the overall spectral power of the signal is reduced and thus, the power of the signal in the time domain is also reduced according to Parseval's theorem.

Generally, the invention relates to a system and method of audio power reduction and thermal mitigation using psychoacoustic techniques. In one embodiment, the method starts by receiving a decoded audio signal in a reproduction system. A masking curve is then generated based on psychoacoustic models and the decoded audio signal. The masking curve is then applied to the decoded audio signal to remove unheard frequencies and generate a power-reduced audio signal.

In one embodiment, a computer-readable storage medium having stored thereon instructions, which when executed by a processor, causes the processor to perform the method of audio power reduction and thermal mitigation using psychoacoustic techniques.

In another embodiment, a system for audio power reduction and thermal mitigation using psychoacoustic techniques comprises an ear-relevant power reducer, an amplifier and a speaker. The ear-relevant power reducer receives a decoded audio signal, generates a masking curve based on psychoacoustic models and the decoded audio signal, and applies the masking curve to the decoded audio signal to remove unheard frequencies and to generate a power-reduced audio signal. The amplifier amplifies the power-reduced audio signal and the speaker plays back the amplified power-reduced audio signal.

The above summary does not include an exhaustive list of all aspects of the present invention. It is contemplated that the invention includes all systems, apparatuses and methods that can be practiced from all suitable combinations of the various aspects summarized above, as well as those disclosed in the Detailed Description below and particularly pointed out in the claims filed with the application. Such combinations may have particular advantages not specifically recited in the above summary.

BRIEF DESCRIPTION OF THE DRAWINGS

The embodiments of the invention are illustrated by way of example and not by way of limitation in the figures of the accompanying drawings in which like references indicate similar elements. It should be noted that references to "an" or "one" embodiment of the invention in this disclosure are not necessarily to the same embodiment, and they mean at least one. In the drawings.

DETAILED DESCRIPTION

In the following description, numerous specific details are set forth. However, it is understood that embodiments of the invention may be practiced without these specific details. In other instances, well-known circuits, structures, and techniques have not been shown to avoid obscuring the understanding of this description.

Figure 1:
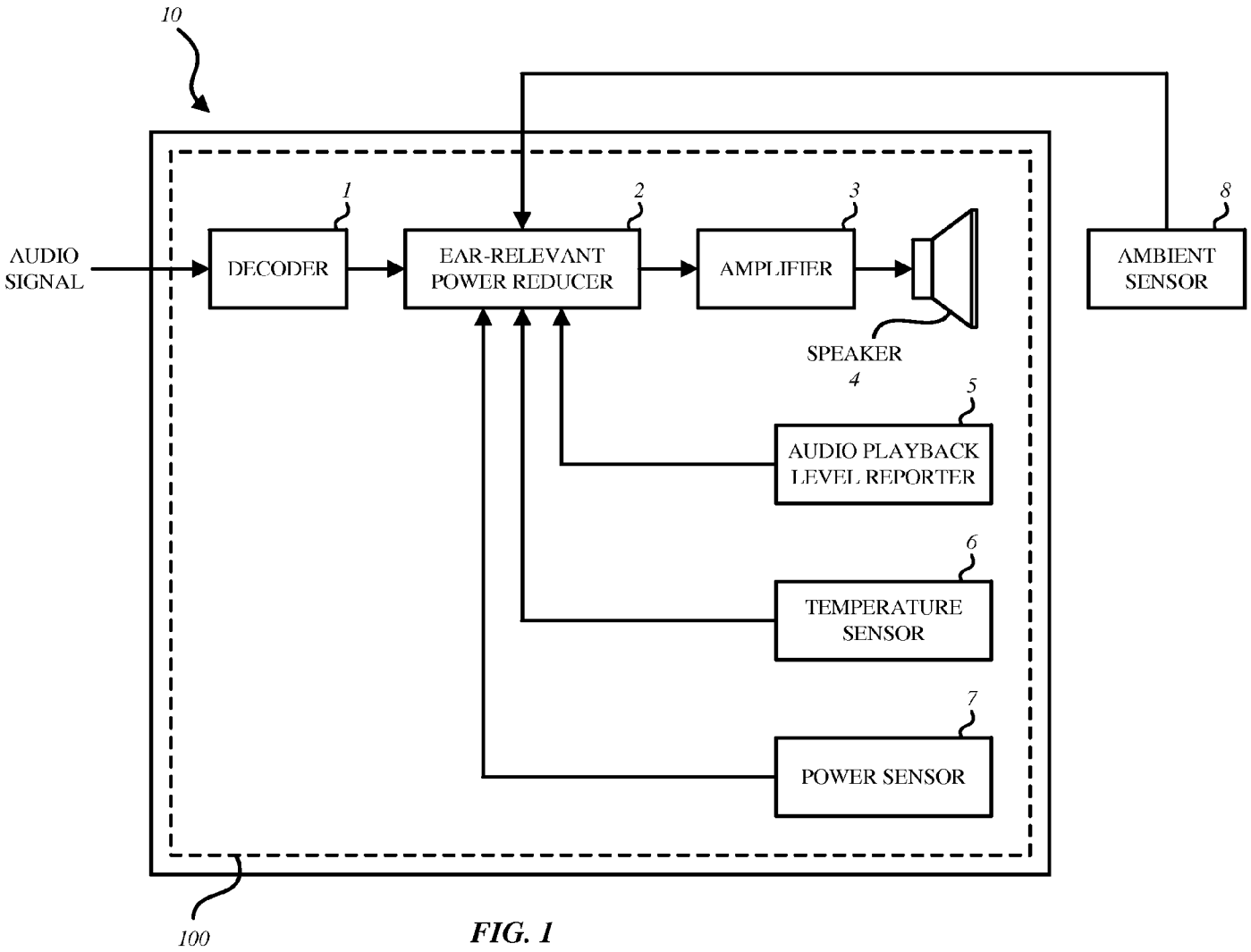
FIG. 1 illustrates a block diagram of an electronic device in which a system for audio power reduction and thermal mitigation using psychoacoustic techniques according to one embodiment of the invention may be implemented.

FIG. 1 illustrates a block diagram of an electronic device in which a system for audio power reduction and thermal mitigation using psychoacoustic techniques according to one embodiment of the invention may be implemented.

The electronic device 10 may be constrained in size and thickness and typically specifies speaker drivers in which an embodiment of the invention may be implemented. The electronic device 10 may be a mobile device such as a mobile telephone communications device or a smartphone. The electronic device 10 may also be a tablet computer, a personal digital media player, a notebook computer, standalone speaker device, or other electronic device. The housing (also referred to as the external housing) encloses a plurality of electronic components of the electronic device 10. For example, the electronic device 10 may include electronic components such as a processor, a data storage containing an operating system and application software for execution by the processor, a display panel, and an audio codec providing audio signals to a speaker driver. The device housing has a speaker port (e.g., an acoustic port) not shown. It is understood that embodiments of the invention may also be implemented in a non-mobile device such as a compact desktop computer.

As shown in FIG. 1, the system 100 for audio power reduction and thermal mitigation using psychoacoustic techniques includes a decoder 1, an ear-relevant power reducer 2, an amplifier 3, a speaker 4, an audio playback level reporter 5, a temperature sensor 6, and a power sensor 7. The system 100 may also include the ambient sensor 8 or, as shown in FIG. 1, the ambient sensor 8 may be external to the system 100. The system 100 may also be an audio reproduction system.

The decoder 1 receives an audio signal from an external source and decodes the audio signal to generate a decoded audio signal. Decoded audio signal may be a decompressed signal to be played back by the speaker 4. The audio signal may include voice, speech, music, sound effects, etc. For instance, the electronic device 10 may be adapted to receive transmissions from a content provider. An example of a "content provider" may include a company providing content for download over the Internet or other Internet Protocol (IP) based networks like an Internet service provider. In addition, the transmissions from the content providers may be a stream of digital content that is configured for transmission to one or more digital devices for viewing and/or listening. According to one embodiment, the transmission may contain MPEG (Moving Pictures Expert Group) compliant compressed video. Thus, the decoder 1 decoding the audio signal that is compressed may include decompressing the compressed audio content (e.g., MPEG) to generate the decoded audio signal to be reproduced by the speaker 4. The electronic device 10 may also be coupled to a digital media player (e.g., DVD player) to receive and display the digital content for viewing and/or listening. Accordingly, when the user is using the electronic device 10 to listen to audio content or to view audio-visual content, the audio signal includes the audio content or the audio portion of the audio-visual content and the sound corresponding to the audio signal may be output by the speaker 4 from the speaker ports of the device 10.

In another embodiment, the electronic device 10 includes wireless communications devices having communications circuitry such as radio frequency (RF) transceiver circuitry, antennas, etc. . . . . In this embodiment, the microphone port, the speaker ports may be coupled to the communications circuitry to enable the user to participate in wireless telephone or video calls. A variety of different wireless communications networks and protocols may be supported in the wireless communications devices. These include: a cellular mobile phone network (e.g. a Global System for Mobile communications, GSM, network), including current 2G, 3G and 4G networks and their associated call and data protocols; and an IEEE 802.11 data network (WiFi or Wireless Local Area Network, WLAN) which may also support wireless voice over internet protocol (VOIP) calling. In one embodiment, the audio signal received by the system 100 includes voice signals that capture the user's speech (e.g., near-end speaker) or voice signals from the far-end speaker.

As shown in FIG. 1, the ear-relevant power reducer 2 receives the decoded audio signal from the decoder 1. In order to reduce the power consumption by the amplifier 3 and the speaker 4, the ear-relevant power reducer 2 uses psychoacoustic techniques (e.g., masking and psychoacoustic effects) to remove the frequencies from the decoded signal that are unheard by the user of the electronic device 10. For instance, if the decoded audio signal includes a loud masking tone and a narrow band tone (e.g., 80 Hz), the tones around the narrow band tone will be unheard. In this example, the ear-relevant power reducer 2 generates a masking curve that masks the tones around the narrow band tone that are unheard such that the only the tone that is heard is amplified by the amplifier 3 and played back by speaker 4. In another example, the ear-relevant power reducer 2 makes use of the threshold of quiet to generate a masking curve to remove the unheard frequencies. Another psychoacoustic technique that may be used by the ear-relevant power reducer 2 involves the temporal masking effect. For example, when the decoded audio signal includes a cymbal crash, the post-masking effect is such that for a period of time (e.g., around 50 ms or more) none of the elements under the post-masking curve is perceivable by the listener due to the cymbal crash. Accordingly, these frequencies may be removed by applying the generated masking curve. In another example, when the decoded audio signal includes castanets sounds, a pre-masking effect may be found. To address the pre-masking effect and the elements under the pre-masking curve, the ear-relevant power reducer 2 may include an amount of look-ahead. The ear-relevant power reducer 2 may use other psychoacoustic techniques to remove the unheard frequencies and generate the power-reduced audio signal.

By removing the unheard frequencies from the decoded signal, the ear-relevant power reducer 2 effective reduces the power consumed by the amplifier 3 and the speaker 4 since the amplifier 3 and the speaker 4 are receiving less frequencies to amplify and play back, respectively. Larger amplifiers such as subwoofers consume a large amount of power to reproduce lower frequencies. Reducing the frequencies that the subwoofers need to reproduce thus reduces the amount of power consumed by the subwoofer. In other words, in view of Parseval's Theorem, by reducing the elements in the decoded audio signal in the frequency domain which are not perceived due to masking by dominant signals (e.g., unheard frequencies), the power of the signal also reduced as well as the amount of power at the driver level that is needed to playback or produce the signal. Additionally, by reducing the frequencies that need to be amplified by amplifier 3 and played back by speaker 4, the heat produced by the amplifier 3, the speaker 4, and the power supply (not shown) are also reduced. In some embodiments, the electronic device 10 may include the power supply (or power source 19) as discussed in FIG. 6. In one embodiment, the system 100 includes the power supply that may be coupled to elements of the system 100 such as, for example, the speaker 3 and speaker 4.

Figure 2:
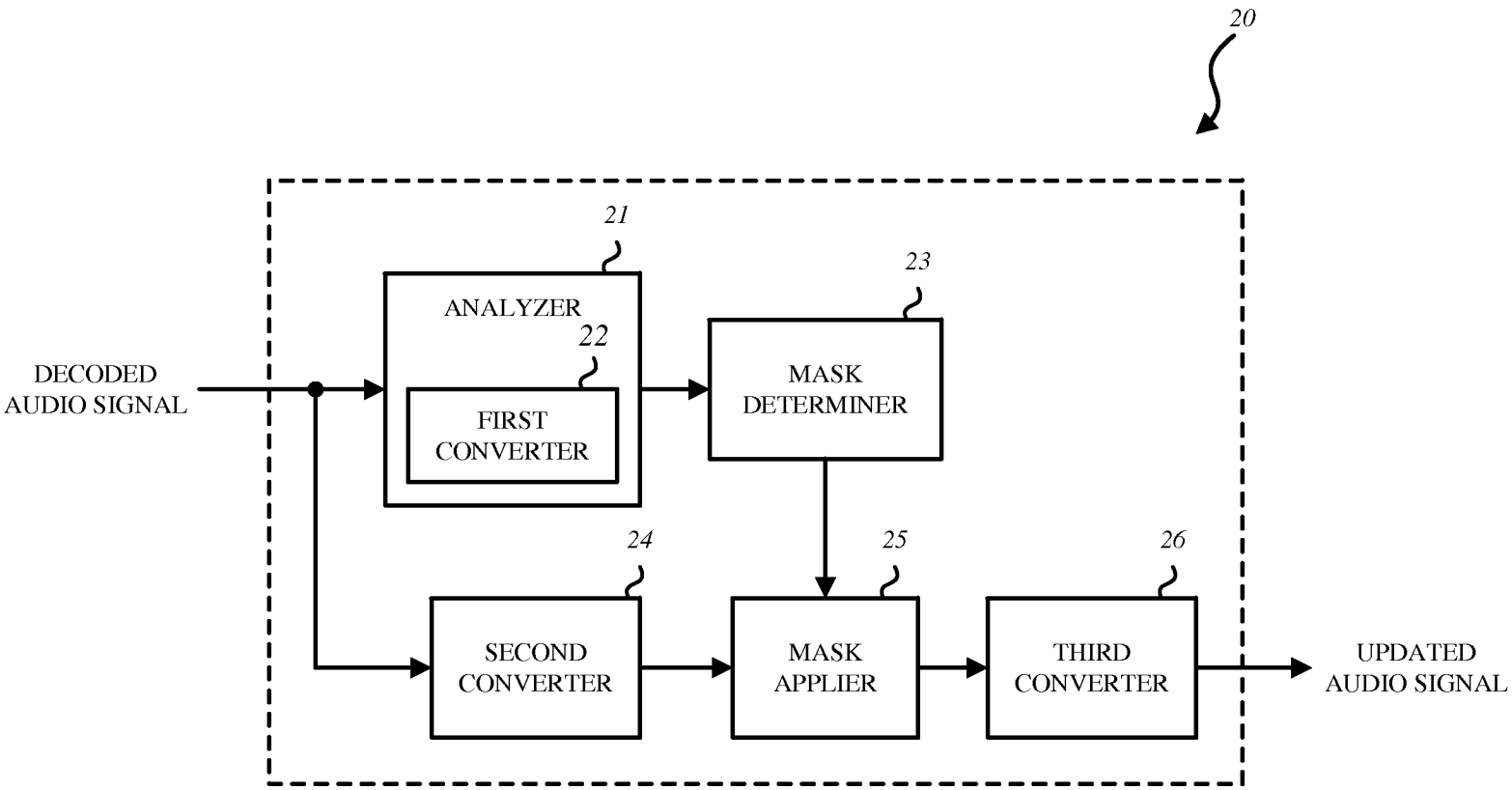
FIG. 2 a block diagram of the details of the ear-relevant power reducer that is included in the system in FIG. 1 according to one embodiment of the invention.

FIG. 2 a block diagram of the details of the ear-relevant power reducer 2 according to one embodiment of the invention. The ear-relevant power reducer 2 generates a masking curve based on psychoacoustic models and the decoded audio signal and applies the masking curve to the decoded audio signal to remove unheard frequencies. The ear-relevant power reducer 2 includes an analyzer 21 having a first converter 22, a mask determiner 23, a second converter, a mask applier 25, and a third converter 26.

As shown in FIG. 2, the analyzer 21 receives the decoded audio signal from the decoder 1. In one embodiment, the analyzer 21 analyzes the decoded audio signal to determine which frequencies are frequencies that may be heard by the user of the electronic device 10. The analyzer 21 may include a first converter 22 convert the decoded audio signal from a time domain to a frequency domain using a first Fast Fourier transform (FFT). In one embodiment, the first FFT 22 via 1024 points is used to convert the decoded audio signal. The mask determiner 23 generates the masking curve using the decoded audio signal in the frequency domain and the determined heard frequencies from the analyzer 21. As further described below, the mask determiner 23 may also generate the masking curve based on received signals from any of one or more of: the ambient sensor 8, the audio playback level reporter 5, the temperature sensor 6, and power sensor 7. (See FIG. 1).

In FIG. 2, the second converter 24 also receives the decoded audio signal from the decoder 1. The second converter 24 may apply a second FFT to the decoded audio signal in the time domain to convert the decoded audio signal in the time domain to the frequency domain. In one embodiment, the second FFT via 512 points is used to convert the decoded audio signal. The mask applier 25 may then apply the masking curve received from the mask determiner 23 to the decoded audio signal in the frequency domain being output from the second converter 24 to remove the unheard frequencies from the decoded audio signal in the frequency domain. The mask applier 25 generates a masked signal in the frequency domain that is transmitted to the third converter 26. The third converter 26 may apply a third FFT to the masked signal in the frequency domain to convert the masked signal in the frequency domain to the time domain. In one embodiment, the third FFT via 512 points is used to convert masked signal in the frequency domain to the time domain. The masked signal in the time domain is the power-reduced audio signal that is output from the ear-relevant power reducer 2 to the amplifier 3 in FIG. 1.

Referring back to FIG. 1, the amplifier 3 receives the power-reduced audio signal that is generated by the ear-relevant power reducer 2 and amplifies the power-reduced audio signal. The speaker 5 may then playback the amplified power-reduced audio signal to a user of the electronic device 10. The user may be in a listening environment external to the electronic device 10 that receives the playback of the power-reduced audio signal. For example, the user may be in a room and the speaker 5 is playing the amplified power-reduced audio signal into the room. In some embodiments, an ambient sensor 8 is located in the listening environment (e.g., the room). The ambient sensor 8 generates an ambient sensor signal that indicates a reverb level of the listening environment and a noise level of the listening environment. In this embodiment, the ear-relevant power reducer 2 generates the masking curve based on the ambient sensing signal. For instance, the masking curve may be generated to aggressively remove more unheard frequencies when the ambient sensing signal indicates a high reverb level of the listening environment or a high noise level of the listening environment. The ear-relevant power reducer 2 may generate a masking curve that removes a greater number of unheard frequencies when the reverb level or the noise level of the speaker is above a threshold than when the reverb level or the noise level of the speaker is below the threshold. The ambient sensor 8 may implement a transfer function inside the room or listening environment that provides an impulse response to the ear-relevant power reducer 2 to generate the masking curves accordingly. The ambient sensor 8 may also include microphones in the vicinity of the user that are communicatively coupled with the ear-relevant power reducer 2. The microphones (not shown) may be air interface sound pickup devices that convert sound into an electrical signal. The microphones may be used to capture the audio signals that are heard by the user such that the microphones may be used to generate the masking curve accordingly.

System 100 may also include the audio playback level reporter 5 generates a feedback signal that indicates an audio playback signal level. The electronic device 10 may receive a volume selection input from the user (e.g., via a mouse or a keyboard used to navigate the user interface on the display screen). This volume selection input sets the volume level (e.g., audio playback signal level) at which the power-reduced audio signal is being amplified by the amplifier 3 and played back to by the speaker 4. In some embodiments, the speaker 4 may be a microspeaker used for mobile devices 10. In other embodiments, speaker 4 may be a speaker included within a standalone speaker device. In this embodiment, the electronic device 10 may be separate from the speaker 4 and communicatively coupled to the speaker 4. The speaker 4 that is a standalone speaker device may include a plurality of speakers. In another embodiment, a plurality of speakers 4 are separate from the electronic device 10 and are standalone speaker devices, respectively, communicatively coupled to the electronic device 10. The audio playback level reporter 5 may be communicatively coupled to the ear-relevant power reducer 2 and transmit the feedback signal to the ear-relevant power reducer 2 that generates the masking curve based on the audio playback signal level. In other embodiments, the ear-relevant power reducer 2 may use the audio playback signal level to select a loudness curve corresponding to the audio playback signal level. The loudness curve may further be used to determine the unheard frequencies and generate a masking curve accordingly. For instance, the masking curve may remove more unheard frequencies when the audio playback signal level is higher than when the audio playback signal level is lower.

As shown in FIG. 1, the temperature sensor 6 may be included in the system 100 and communicatively coupled to the ear-relevant power reducer 2. The temperature sensor 6 measures the temperature of the speaker 4. In some embodiments, the temperature sensor 6 measures the temperature of the voice coil included in the speaker 4. In other embodiments, the temperature sensor 6 may measure the temperature of other elements in the system 100 or the device 10. The temperature sensor 6 then generates a temperature sensor signal that is transmitted to the ear-relevant power reducer 2, which, in turn, generates the masking curve based on the temperature of the speaker 4. For example, the ear-relevant power reducer 2 may generate the masking curve to remove a greater number of unheard frequencies when the temperature of the speaker is above a threshold than when the temperature of the speaker is below the threshold. In this example, the system 100 is more tolerant of distortion in the audio playback by the speaker 4 when the temperature sensor signal indicates a higher temperature.

In FIG. 1, the power sensor 7 may also be communicatively coupled to the ear-relevant power reducer 2. The power sensor 7 generates a power supply signal that indicates the power level of the system 100. For instance, the power level of the system 100 may be the remaining battery power of the electronic device 10. In this embodiment, the ear-relevant power reducer 2 receives the power supply signal and generates the masking curve based on the power level of the system 100. For example, the ear-relevant power reducer 2 may generate the masking curve to remove a greater number of unheard frequencies when the power level is below a threshold than when the power level is above the threshold.

Figure 6:
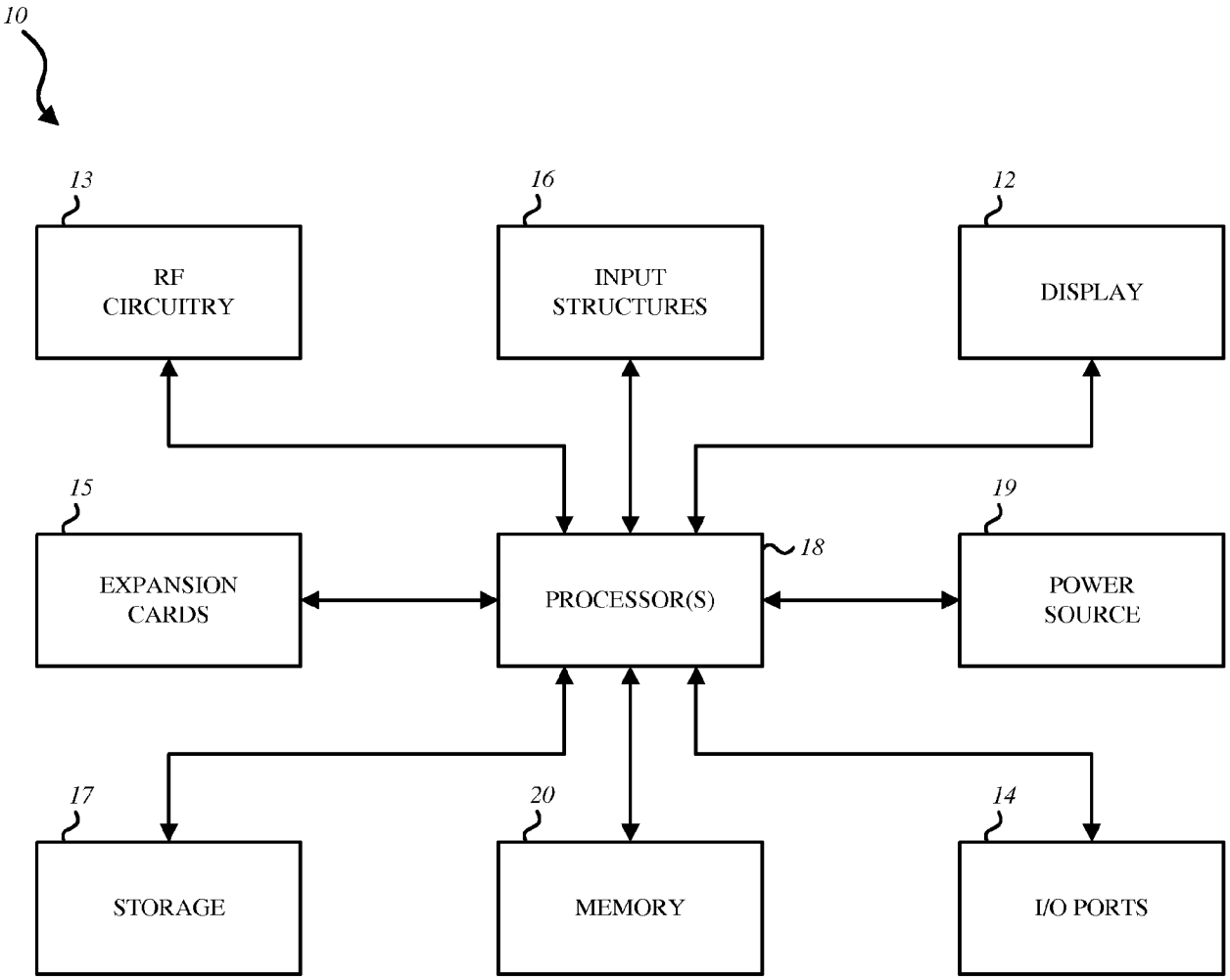
FIG. 6 is a block diagram of exemplary components of an electronic device in which the system for audio power reduction and thermal mitigation using psychoacoustic techniques may be implemented in accordance with aspects of the present disclosure.

In one embodiment, system 100 is coupled to processing circuitry and storage that is included in electronic device 10 as discussed in FIG. 6. The processing circuitry included in device 10 may include a processor 18, such as a microprocessor, a microcontroller, a digital signal processor, or a central processing unit, and other needed integrated circuits such as glue logic. The term "processor" may refer to a device having two or more processing units or elements, e.g. a CPU with multiple processing cores. The processing circuitry may be used to control the operations of device 10 by executing software instructions or code stored in the storage 17. The storage 17 may include one or more different types of storage such as hard disk drive storage, nonvolatile memory 20, and volatile memory 20 such as dynamic random access memory. In some cases, a particular function as described below may be implemented as two or more pieces of software in the storage 17 that are being executed by different hardware units of a processor. The processing circuitry may execute instructions stored in memory that causes the processing circuitry to perform the method of audio power reduction and thermal mitigation using psychoacoustic techniques according to the embodiments as described herein. The processing circuitry may also execute instructions stored in memory that causes the processing circuitry to control the functions of each of the components of system 1 to cause the components (e.g., the decoder 1, the ear-relevant power reducer 2, the amplifier 3, the speaker 4, the audio playback level reporter 5, the temperature sensor 6, the power sensor 7, and the ambient sensor 8, etc.) to perform the functions according to the embodiments as described herein.

Moreover, the following embodiments of the invention may be described as a process, which is usually depicted as a flowchart, a flow diagram, a structure diagram, or a block diagram. Although a flowchart may describe the operations as a sequential process, many of the operations can be performed in parallel or concurrently. In addition, the order of the operations may be re-arranged. A process is terminated when its operations are completed. A process may correspond to a method, a procedure, etc.

Figure 3:
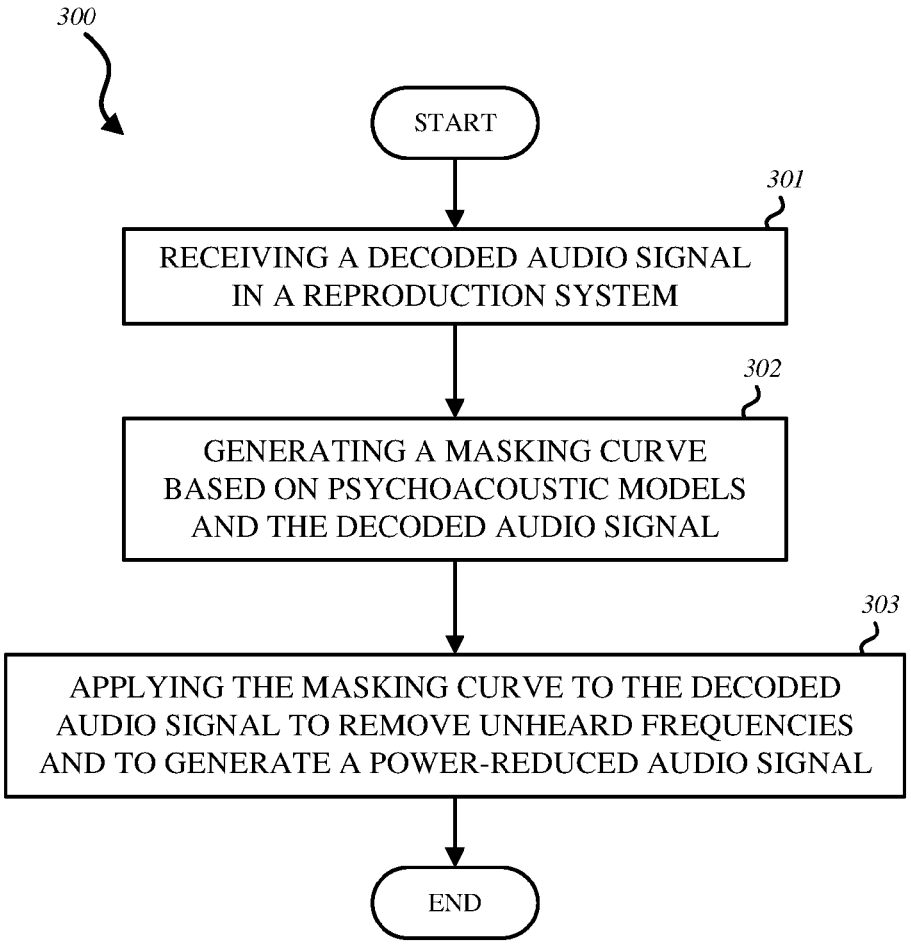
FIG. 3 illustrates a flow diagram of an example method for audio power reduction and thermal mitigation using psychoacoustic techniques according to an embodiment of the invention.

FIG. 3 illustrates a flow diagram of an example method for audio power reduction and thermal mitigation using psychoacoustic techniques according to an embodiment of the invention. Method 300 starts by receiving a decoded audio signal in a reproduction system 100 in Block 301. At Block 302, a masking curve is generated based on psychoacoustic and the decoded audio signal and, at Block 303, the masking curve is applied to the decoded audio signal to remove unheard frequencies and to generate a power-reduced audio signal.

Figure 4:
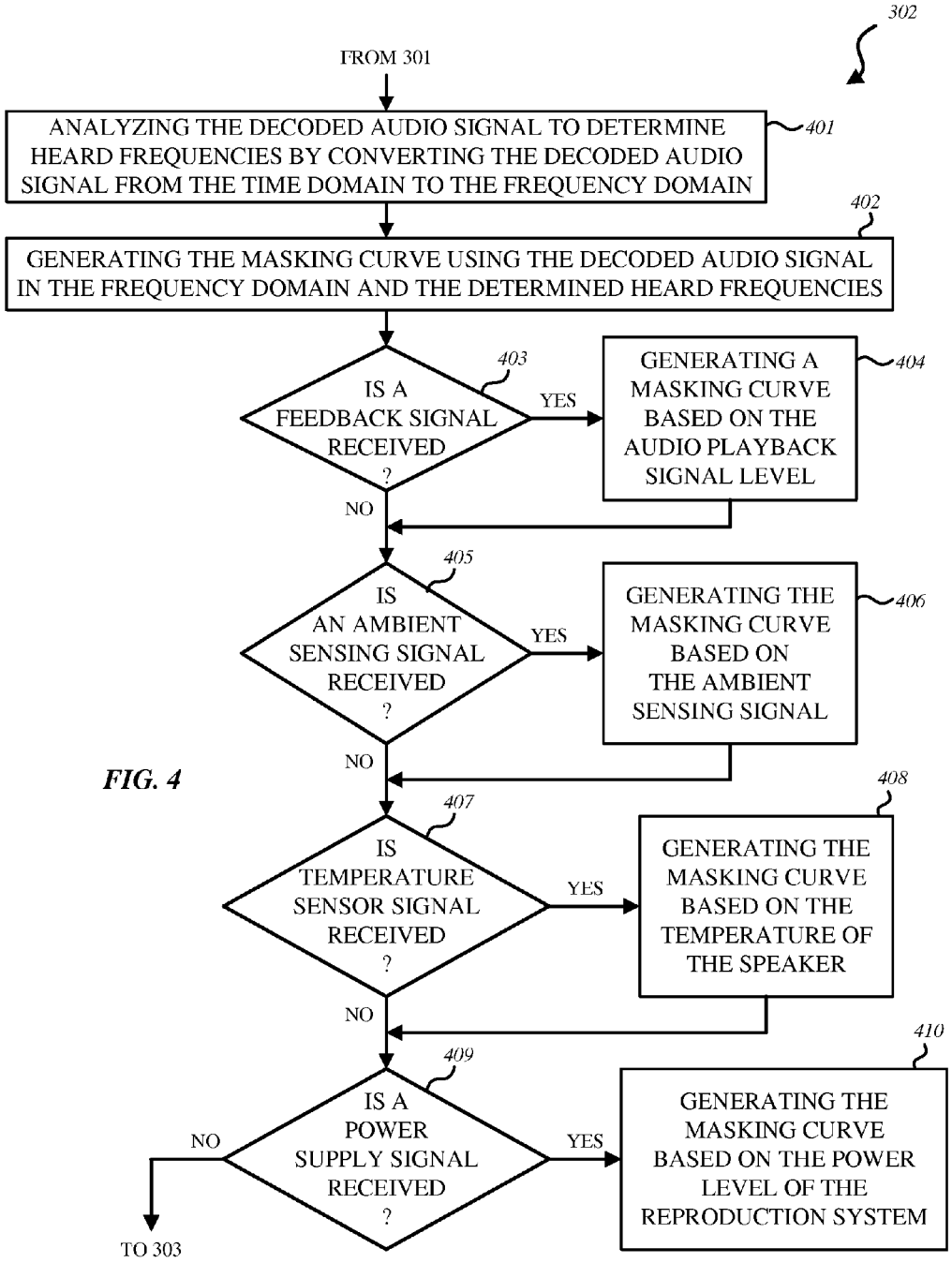
FIG. 4 illustrates a flow diagram of the details of generating a masking curve in Block 302 of the example method in FIG. 3 of audio power reduction and thermal mitigation using psychoacoustic techniques according to an embodiment of the invention.

FIG. 4 illustrates a flow diagram of the details of generating a masking curve in Block 302 of the example method in FIG. 3 according to an embodiment of the invention. At Block 401, the decoded audio signal is analyzed to determine heard frequencies by converting the decoded audio signal from the time domain to the frequency domain. At Block 402, the masking curve is generated using the decoded audio signal in the frequency domain and the determined heard frequencies. At Block 403, it is determined whether a feedback signal that indicates an audio feedback signal level is received. If no feedback signal is received, the method moves to Block 405. If the feedback signal is received, at Block 404, the masking curve is generated based on the audio playback signal level indicated by the feedback signal. At Block 405, it is determined whether an ambient sensing signal is received. The ambient sensing signal indicates a reverb level of an environment and a noise level of the environment. The environment is external to the reproduction system and receives a playback of the power-reduced audio signal. If no ambient sensing signal is received, the method moves to Block 407. If the ambient sensing signal is received, at Block 406, the masking curve is generated based on the ambient sensing signal. At Block 407, it is determined whether a temperature sensor signal is received. The temperature sensor signal indicates a temperature of a speaker in the reproduction system. If no temperature sensing signal is received, the method moves to Block 409. If a temperature sensing signal is received, at Block 408, the masking curve is generated based on the temperature of the speaker. For instance, the masking curve that is generated may remove a greater number of unheard frequencies when the temperature of the speaker is above a threshold than when the temperature of the speaker is below the threshold. At Block 409, it is determined whether a power supply signal is received. If a power supply signal is received, at Block 410, the masking curve is generated based on the power level of the reproduction system. For instance, the masking curve that is generated may remove a greater number of unheard frequencies when the power level is below a threshold than when the power level is above the threshold.

Figure 5:
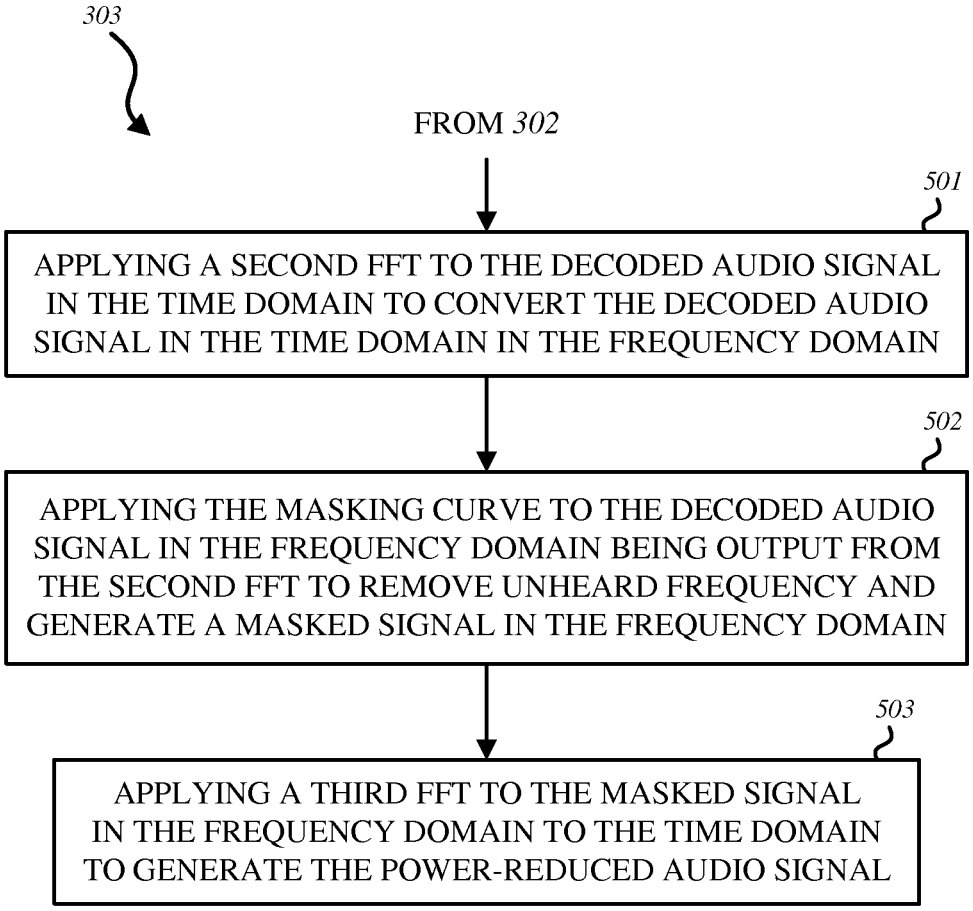
FIG. 5 illustrates a flow diagram of the details of applying a masking curve to the decoded audio signal in Block 303 of the example method in FIG. 3 of audio power reduction and thermal mitigation using psychoacoustic techniques according to an embodiment of the invention.

FIG. 5 illustrates a flow diagram of the details of applying a masking curve to the decoded audio signal in Block 303 of the example method in FIG. 3 according to an embodiment of the invention. The method starts at Block 501 by applying a second FFT to the decoded audio signal in the time domain to convert the decoded audio signal in the time domain to the frequency domain. At Block 502, the masking curve received from the mask determiner is applied to decoded audio signal in the frequency domain being output from the second converter to remove the unheard frequencies and generate a masked signal in the frequency domain. At Block 503, a third FFT is applied to the masked signal in the frequency domain to convert the masked signal in the frequency domain to the time domain. The masked signal in the time domain is the power-reduced audio signal that is outputted from the ear-relevant power reducer 2.

FIG. 6 is a block diagram of exemplary components of an electronic device 10 in which the system 1 for audio power reduction and thermal mitigation using psychoacoustic techniques may be implemented in accordance with aspects of the present disclosure. A general description of suitable electronic devices for performing these functions is provided below with respect to FIG. 6. Specifically, FIG. 6 is a block diagram depicting various components that may be present in electronic devices suitable for use with the present techniques. The electronic device 10 may be in the form of a computer, a handheld portable electronic device, and/or a computing device having a tablet-style form factor. These types of electronic devices, as well as other electronic devices providing comparable functionalities may be used in conjunction with the present techniques.

Keeping the above points in mind, FIG. 6 is a block diagram illustrating components that may be present in one such electronic device 10, and which may allow the device 10 to function in accordance with the techniques discussed herein. The various functional blocks shown in FIG. 6 may include hardware elements (including circuitry), software elements (including computer code stored on a computer-readable medium, such as a hard drive or system memory), or a combination of both hardware and software elements. It should be noted that FIG. 6 is merely one example of a particular implementation and is merely intended to illustrate the types of components that may be present in the electronic device 10. For example, in the illustrated embodiment, these components may include a display 12, input/output (I/O) ports 14, input structures 16, one or more processors 18, memory device(s) 20, non-volatile storage 17, expansion card(s) 15, RF circuitry 13, and power source 19.

In the embodiment of the electronic device 10 in the form of a computer, the embodiment include computers that are generally portable (such as laptop, notebook, tablet, and handheld computers), as well as computers that are generally used in one place (such as conventional desktop computers, workstations, and servers).

The electronic device 10 may also take the form of other types of devices, such as mobile telephones, media players, personal data organizers, handheld game platforms, cameras, and/or combinations of such devices. For instance, the device 10 may be provided in the form of a handheld electronic device that includes various functionalities (such as the ability to take pictures, make telephone calls, access the Internet, communicate via email, record audio and/or video, listen to music, play games, connect to wireless networks, and so forth).

In another embodiment, the electronic device 10 may also be provided in the form of a portable multi-function tablet computing device. In certain embodiments, the tablet computing device may provide the functionality of media player, a web browser, a cellular phone, a gaming platform, a personal data organizer, and so forth.

An embodiment of the invention may be a machine-readable medium having stored thereon instructions which program a processor to perform some or all of the operations described above. A machine-readable medium may include any mechanism for storing or transmitting information in a form readable by a machine (e.g., a computer), such as Compact Disc Read-Only Memory (CD-ROMs), Read-Only Memory (ROMs), Random Access Memory (RAM), and Erasable Programmable Read-Only Memory (EPROM). In other embodiments, some of these operations might be performed by specific hardware components that contain hardwired logic. Those operations might alternatively be performed by any combination of programmable computer components and fixed hardware circuit components. In one embodiment, the machine-readable medium includes instructions stored thereon, which when executed by a processor, causes the processor to perform the methods as described above.

In the description, certain terminology is used to describe features of the invention. For example, in certain situations, the terms "component," "unit," "module," and "logic" are representative of hardware and/or software configured to perform one or more functions. For instance, examples of "hardware" include, but are not limited or restricted to an integrated circuit such as a processor (e.g., a digital signal processor, microprocessor, application specific integrated circuit, a micro-controller, etc.). Of course, the hardware may be alternatively implemented as a finite state machine or even combinatorial logic. An example of "software" includes executable code in the form of an application, an applet, a routine or even a series of instructions. The software may be stored in any type of machine-readable medium.

While the invention has been described in terms of several embodiments, those of ordinary skill in the art will recognize that the invention is not limited to the embodiments described, but can be practiced with modification and alteration within the spirit and scope of the appended claims. The description is thus to be regarded as illustrative instead of limiting. There are numerous other variations to different aspects of the invention described above, which in the interest of conciseness have not been provided in detail. Accordingly, other embodiments are within the scope of the claims.

What is claimed is:

1. A method of audio power reduction and thermal mitigation using psychoacoustic techniques comprising:

receiving a decoded audio signal in a reproduction system;

generating a masking curve based on psychoacoustic models and the decoded audio signal, wherein generating the masking curve includes:

analyzing the decoded audio signal to determine heard frequencies by converting the decoded audio signal from a time domain to a frequency domain, and generating the masking curve using the decoded audio signal in the frequency domain and the determined heard frequencies;

applying the masking curve to the decoded audio signal to remove unheard frequencies and to generate a power-reduced audio signal; and playing back the power-reduced audio signal by a speaker in the reproduction system.

2. The method of claim 1, wherein the decoded audio signal is converted from the time domain to the frequency domain using a first Fast Fourier transform (FFT).

3. The method of claim 2, wherein the first FFT via 1024 points is used to convert the decoded audio signal from the time domain to the frequency domain.

4. The method of claim 1, wherein applying the masking curve further comprises:

applying a second FFT to the decoded audio signal in the time domain to convert the decoded audio signal in the time domain to the frequency domain;

applying the masking curve to decoded audio signal in the frequency domain being output from the second FFT to remove the unheard frequencies and generate a masked signal in the frequency domain; and applying a third FFT to the masked signal in the frequency domain to convert the masked signal in the frequency domain to the time domain, wherein the masked signal in the time domain is the power-reduced audio signal.

5. The method of claim 4, wherein the second FFT via 512 points is used to convert the decoded audio signal in the time domain to the frequency domain and wherein the third FFT via 512 points is used to convert masked signal in the frequency domain to the time domain.

6. The method of claim 1, wherein generating the masking curve further comprises:

receiving a feedback signal that indicates an audio playback signal level; and generating the masking curve based on the audio playback signal level.

7. The method of claim 1, wherein generating the masking curve further comprises:

receiving an ambient sensing signal that indicates a reverb level of an environment and a noise level of the environment, wherein the environment is external to the reproduction system and receives a playback of the power-reduced audio signal, and generating the masking curve based on the ambient sensing signal.

8. The method of claim 1, wherein generating the masking curve further comprises:

receiving a temperature sensor signal that indicates a temperature of a speaker in the reproduction system; and generating the masking curve based on the temperature of the speaker, wherein the masking curve removes a greater number of unheard frequencies when the temperature of the speaker is above a threshold than when the temperature of the speaker is below the threshold.

9. The method of claim 1, wherein generating the masking curve further comprises:

receiving a power supply signal that indicates a power level of the reproduction system; and generating the masking curve based on the power level, wherein the masking curve removes a greater number of unheard frequencies when the power level is below a threshold than when the power level is above the threshold.

10. The method of claim 1, further comprising:

amplifying the power-reduced audio signal; and playing back the amplified power-reduced audio signal by the speaker in the reproduction system.

11. A system for audio power reduction and thermal mitigation using psychoacoustic techniques comprising:

an ear-relevant power reducer that includes a processor:

to receive a decoded audio signal, to analyze the decoded audio signal to determine heard frequencies, and to convert the decoded audio signal from a time domain to a frequency domain, to generate a masking curve based on psychoacoustic models and the decoded audio signal, wherein the masking curve is generated using the decoded audio signal in the frequency domain and the determined heard frequencies, and to apply the masking curve to the decoded audio signal to remove unheard frequencies and to generate a power-reduced audio signal;

an amplifier to amplify the power-reduced audio signal; and a speaker to playback the amplified power-reduced audio signal.

12. The system in claim 11, wherein the decoded audio signal is converted from the time domain to the frequency domain using a first Fast Fourier transform (FFT).

13. The system of claim 11, wherein the processor is further:

to apply a second FFT to the decoded audio signal in the time domain to convert the decoded audio signal in the time domain to the frequency domain, to apply the masking curve to decoded audio signal in the frequency domain being output from the second converter to remove the unheard frequencies and generate a masked signal in the frequency domain, and to apply a third FFT to the masked signal in the frequency domain to convert the masked signal in the frequency domain to the time domain, wherein the masked signal in the time domain is the power-reduced audio signal.

14. The system of claim 13, wherein the processor is further to:

receive a feedback signal that indicates an audio playback signal level, and generate the masking curve based on the audio playback signal level.

15. The system of claim 13, wherein the processor is further to:

receive from a sensor external to the system an ambient sensing signal that indicates a reverb level of an environment and a noise level of the environment, wherein the environment is external to the system and receives a playback of the power-reduced audio signal, and generate the masking curve based on the ambient sensing signal.

16. The system of claim 13, wherein the processor is further to:

receive a temperature sensor signal from a temperature sensor that indicates a temperature of the speaker, and generate the masking curve based on the temperature of the speaker, wherein the masking curve removes a greater number of unheard frequencies when the temperature of the speaker is above a threshold than when the temperature of the speaker is below the threshold.

17. The system of claim 13, wherein the processor is further to:

receive a power supply signal that indicates a power level of the system; and generate the masking curve based on the power level, wherein the masking curve removes a greater number of unheard frequencies when the power level is below a threshold than when the power level is above the threshold.

18. A non-transitory computer-readable storage medium having stored thereon instructions, when executed by a processor, causes the processor to perform a method of audio power reduction and thermal mitigation using psychoacoustic techniques comprising:

receiving a decoded audio signal in a reproduction system;

generating a masking curve based on psychoacoustic models and the decoded audio signal, wherein generating the masking curves includes:

analyzing the decoded audio signal to determine heard frequencies by converting the decoded audio signal from a time domain to a frequency domain, and generating the masking curve using the decoded audio signal in the frequency domain and the determined heard frequencies;

applying the masking curve to the decoded audio signal to remove unheard frequencies and to generate a power-reduced audio signal; and playing back the power-reduced audio signal via a speaker in the reproduction system.

19. The non-transitory computer-readable storage medium of claim 18, wherein the decoded audio signal is converted from the time domain to the frequency domain using a first Fast Fourier transform (FFT).

20. The non-transitory computer-readable storage medium of claim 18, wherein applying the masking curve further comprises:

applying a second FFT to the decoded audio signal in the time domain to convert the decoded audio signal in the time domain to the frequency domain;

applying the masking curve to decoded audio signal in the frequency domain being output from the second FFT to remove the unheard frequencies and generate a masked signal in the frequency domain; and applying a third FFT to the masked signal in the frequency domain to convert the masked signal in the frequency domain to the time domain, wherein the masked signal in the time domain is the power-reduced audio signal.

21. The non-transitory computer-readable storage medium of claim 20, wherein generating the masking curve further comprises:

receiving a feedback signal that indicates an audio playback signal level; and generating the masking curve based on the audio playback signal level.

22. The computer-readable storage medium of claim 20, wherein generating the masking curve further comprises:

receiving an ambient sensing signal that indicates a reverb level of an environment and a noise level of the environment, wherein the environment is external to the reproduction system and receives a playback of the power-reduced audio signal, and generating the masking curve based on the ambient sensing signal.

23. The non-transitory computer-readable storage medium of claim 20, wherein generating the masking curve further comprises:

receiving a temperature sensor signal that indicates a temperature of a speaker in the reproduction system; and generating the masking curve based on the temperature of the speaker, wherein the masking curve removes a greater number of unheard frequencies when the temperature of the speaker is above a threshold than when the temperature of the speaker is below the threshold.

24. The non-transitory computer-readable storage medium of claim 20, wherein generating the masking curve further comprises:

receiving a power supply signal that indicates a power level of the reproduction system; and generating the masking curve based on the power level, wherein the masking curve removes a greater number of unheard frequencies when the power level is below a threshold than when the power level is above the threshold.

25. The non-transitory computer-readable storage medium of claim 18, having stored thereon instructions, when executed by the processor, causes the processor to perform the method further comprising:

amplifying the power-reduced audio signal; and playing back the amplified power-reduced audio signal via the speaker in the reproduction system.

* * * * *